US006049935A

United States Patent [19]

Zemel

[11] Patent Number: 6,049,935

[45] Date of Patent: Apr. 18, 2000

[54] ANSATE CLEANING IMPLEMENT WITH REMOVABLE SCRUBBER ELEMENT

[75] Inventor: Marc Zemel, Old Bethpage, N.Y.

[73] Assignee: Mr. Bar-B-Q, Inc., Old Bethpage, N.Y.

[21] Appl. No.: 09/133,554

[22] Filed: Aug. 13, 1998

[51] Int. Cl.[7] ..... A47L 13/06

[52] U.S. Cl. ..... 15/111; 15/176.6

[58] Field of Search ..... 15/111, 113, 176.1–176.6

[56] References Cited

U.S. PATENT DOCUMENTS

| | | | |
|---|---|---|---|
| 856,168 | 6/1907 | Lykken . | |
| 1,396,630 | 11/1921 | Higbee | 15/176.4 |
| 1,536,542 | 5/1925 | Wegner | 15/111 |
| 1,676,857 | 7/1928 | Cheron | 15/111 |
| 2,306,051 | 12/1942 | Ghelber . | |
| 3,094,728 | 6/1963 | White . | |
| 3,167,799 | 2/1965 | McKinley | 155/176.4 |
| 4,319,379 | 3/1982 | Carrigan et al. | 15/176.3 |
| 4,571,766 | 2/1986 | Goldman et al. . | |
| 5,373,600 | 12/1994 | Stojanovski et al. | 15/111 |

FOREIGN PATENT DOCUMENTS

| | | | |
|---|---|---|---|
| 894974 | 1/1945 | France | 15/176.6 |

OTHER PUBLICATIONS

Charcoal Companion—product packaging header copyright 1993 (front and back).

*Primary Examiner*—Terrence R. Till
*Attorney, Agent, or Firm*—Natter & Natter

[57] ABSTRACT

An ansate cleaning implement includes a base having front and rear faces with the front face including a socket of reduced thickness which receives a replaceable scrubber element. The scrubber element includes a support plate carrying bristles, a scrub pad or other cleansing medium. The socket is peripherally defined by a circumscribing boundary wall. A plurality of screws extend through transverse apertures in the base and into a support plate of the scrubber element to releasable retain scrubber element so that it may be removed for cleaning in a dishwasher, etc., replacement or substitution with an element having a different cleansing medium.

20 Claims, 2 Drawing Sheets

ANSATE CLEANING IMPLEMENT WITH REMOVABLE SCRUBBER ELEMENT

BACKGROUND OF THE INVENTION

1. Field of the Invention

This invention relates generally to cleaning implements and more particularly to a cleaning implement with a removable scrubber element suitable for use with cooking surfaces such as grills.

2. Related History

The cleaning of cooking implements such as grills, for example, including barbecue grill grates, was a time consuming and often arduous task. The accumulation of solid food particles as well as grease upon grill surfaces presented unique problems. Burnt food particles were found caked to grill grates. Liquid, paste and abrasive cleansers often left their own residue which presented a source of possible food contamination.

Among the cleaning devices heretofore employed for such tasks were metal scrapers, fibrous metal and nonmetal cleaning pads and brushes, including wire brushes with metal bristles. Food particles and grease removed from the grill, however, often remained on the cleaning tools, intertwined with the brush bristles and embedded in the cleaning pads and the removal of such matter from the cleaning implements constituted a task more challenging than the cleaning of the grill itself. In many instances, the accumulated food particles and grease could not be effectively removed from brush bristles and cleaning pads, even when placed in a dishwasher. Further, the placement of grill cleaning brushes, especially those with oversized long handles, within a dishwasher was problematic since the dishwasher space occupied by the cleaning implement often required the removal of other items which were to be cleaned in the dishwasher or interfered with the operation of dishwasher spray arms and the like.

Further, grill cleaning brushes were subject to relatively rapid wear and were often in need of replacement prior to the end of a single summer cooking season. Long handled brushes especially, were relatively costly and frequent replacement was necessary but unavoidable. In addition, it has been found that bacteria carried in uncooked and undercooked meat and poultry often transferred to wood implements such as cutting boards, trays and barbecue tools including wood handles of cleaning tools. The removal of such contamination from wood handled cleaning tools by placement in a dishwasher was impractical.

SUMMARY OF THE INVENTION

A molded plastic one-piece cleaning implement includes a base having a handle for manipulation with the base having front and back faces. The base includes a socket formed in the front face and which extends toward the back face.

A replaceable scrubber element is carried in the socket. The scrubber element includes a support plate which is dimensioned to be captively received in the socket with the support plate carrying a cleansing medium comprising bristles, a pad or other suitable material.

The socket is circumscribed a boundary wall which extends from the front face of the base to an axial end face of the socket. Lateral and axial rubbing forces encountered by the scrubber element during cleaning are borne by the boundary wall.

Extending from the back face of the base into the support plate are a plurality of screws which retain the support plate in the socket against the axial end face of the socket.

From the foregoing compendium, it will be appreciated that it is an aspect of the present invention to provide an ansate cleaning implement of the general character described which is not subject to the advantages of the related history of the invention.

It is a feature of the present invention to provide an ansate cleaning implement of the general character described which is relatively low in cost and suitable for economical mass production fabrication.

It is a consideration of the present invention to provide an ansate cleaning implement of the general character described which is readily cleanable and thus promotes hygienic food preparation.

Another aspect of the present invention is to provide an ansate cleaning implement of the general character described wherein a scrubber element is easily replaceable.

A further feature of the present invention is to provide an ansate cleaning implement of the general character described which includes a variety of interchangeable scrubbing elements.

Another consideration of the present invention is to provide an ansate cleaning implement of the general character described which is easy to use.

To provide an ansate cleaning implement of the general character described which prolongs the useful life of a scrubber element by facilitating frequent cleaning is a further feature of the present invention.

Another aspect of the present invention is to provide an ansate cleaning implement of the general character described which fosters environmental conservation by promoting the replacement of only unusable scrubber elements, thus reducing wastage.

A still further feature of the present invention is to provide an ansate cleaning implement of the general character described wherein a removable scrubber element is captively retained within a socket for resistance to dislodgement forces encountered during usage.

To provide an ansate cleaning implement of the general character described which fosters frequent hygienic dishwasher cleansing is a further consideration of the present invention.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations aforementioned and certain other aspects, features and considerations are attained, all with reference to the accompanying drawings in the scope of which will be more particularly pointed out and indicated in the appended claims.

BRIEF DESCRIPTION OF THE DRAWINGS

In the accompanying drawings, in which are shown some of the various possible exemplary embodiments of the invention.

DESCRIPTION OF THE PREFERRED EMBODIMENT

Figure 1:
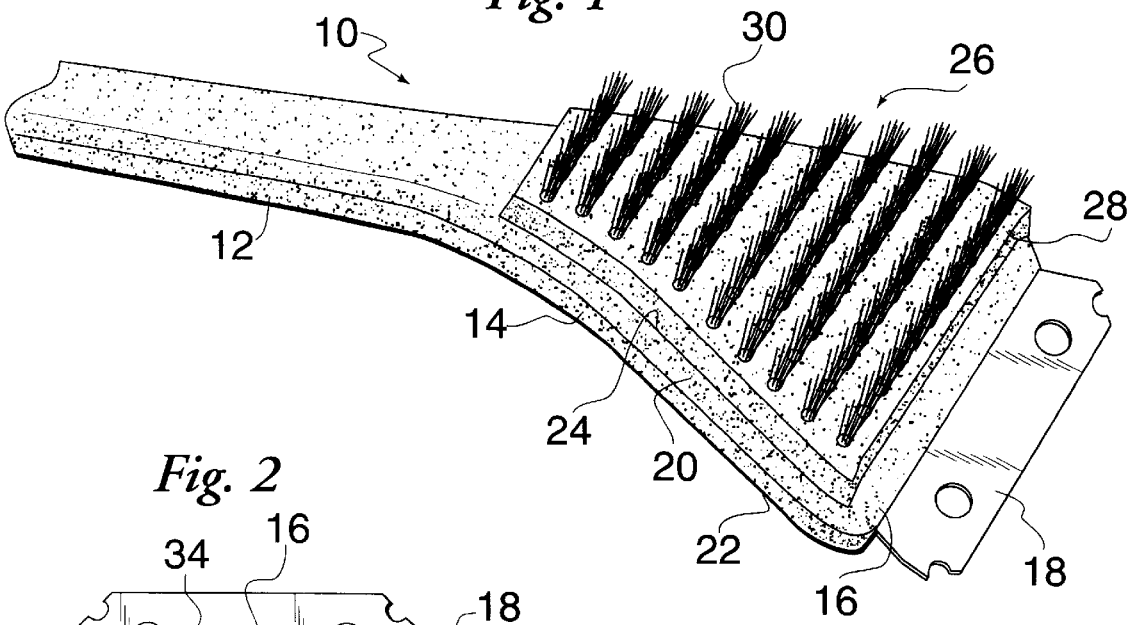
FIG. 1 is a perspective view of an ansate cleaning implement constructed in accordance with and embodying the invention and showing a removable scrubber element seated within a socket formed in a base of the implement.
Figure 2:
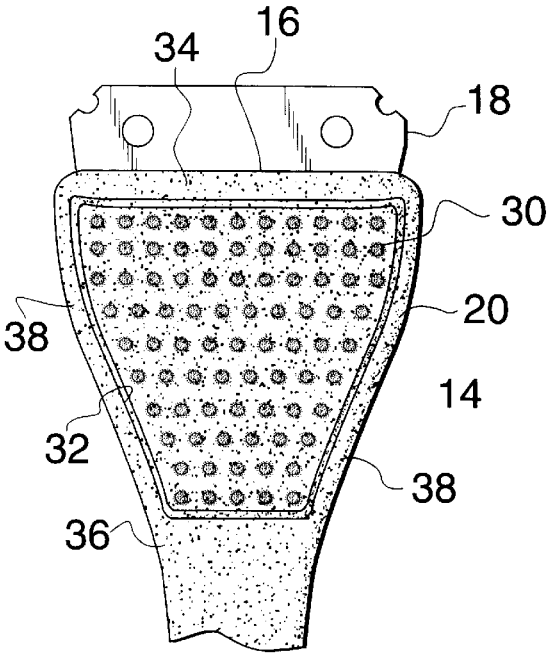
FIG. 2 is an enlarged fragmentary top plan view of the ansate cleaning implement and more clearly illustrating the base and showing the scrubber element.

Referring now in detail to the drawings, the reference numeral 10 denotes generally an ansate cleaning implement constructed in accordance with and embodying the invention. The cleaning implement 10 includes an elongate handle 12 and an enlarged base 14 of generally triangular configuration, with the handle 12 depending from an apex of the base. Preferably, the handle and base are formed of unitary one-piece construction and fabricated of an easily cleanable nonporous durable material such as plastic resin or metal.

Projecting from a leading edge 16 of the base 14 is a grill scraper blade 18 of conventional configuration.

The base 14 includes a front face 20 which is intended to be oriented toward the surface in need of cleaning and a rear face 22, which is intended to be oriented toward the user. The front and rear faces 20, 22 are uniformly spaced from one another and are configured, in an exemplary manner, as concentric arcs.

In accordance with the invention, the front face 20 includes a central indented or hollowed out socket 24 which receives a replaceable scrubber element 26. The scrubber element 26 is shaped in plan configuration to mate with that of the base 14. Accordingly, with a base 14 of generally triangular plan configuration, the scrubber element 26 is of generally trapezoidal plan configuration.

A typical scrubber element 26, illustrated in FIGS. 1 through 5, comprises a support plate 28 and a plurality of bristles 30 projecting from an external face of the plate.

The socket 24 which receives the scrubber element 26 is defined by a boundary wall 32 extending from the front face 20 of the base 14 to an axial end face 33 of the socket 24. It should be appreciated that the socket 24, and the scrubber element 26 are thus completely surrounded by a forward border 34 extending between the boundary wall 32 and the leading edge 16, a rear border 36, extending between the boundary wall and the handle 12 and a pair of side borders 38 positioned between the boundary wall 32 and the side edges of the base 14.

Figure 4:
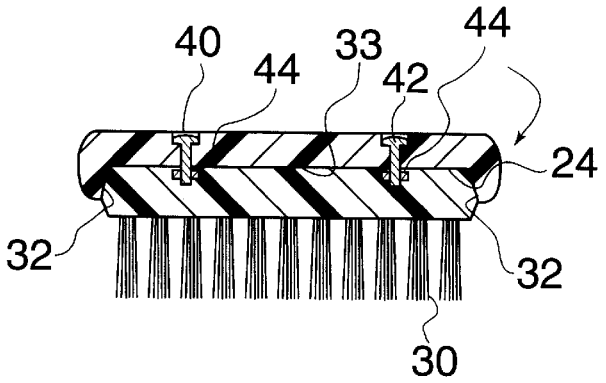
FIG. 4 is a sectional view through the base, the same being taken substantially along the line 4—4 of FIG. 3.
Figure 5:
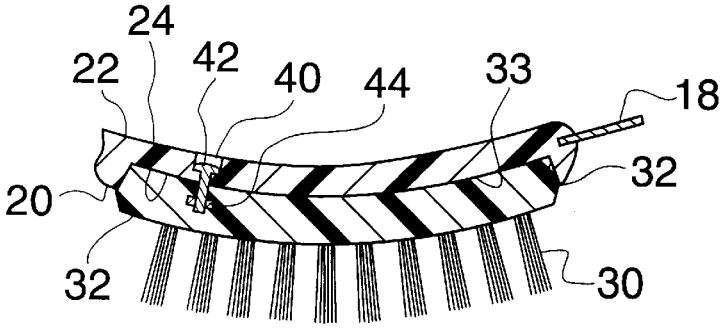
FIG. 5 is a longitudinal sectional view through the cleaning implement, the same being taken substantially along the line 5—5 of FIG. 3.

As will be noted from FIG. 4 and from FIG. 5, the base 14 has a minimum thickness at the axial end face 33 of the socket 24 which is less than the thickness of the base between the boundary wall 32 and the leading edge 16, between the boundary wall 32 and the side edges and between the boundary wall 32 and the handle 12.

The borders 34, 36 will bear axial loads encountered by front to back engagement of the scrubber element cleansing medium, e.g. the bristles 30 and the surface being cleaned, while the side borders 38 will bear the lateral loads encountered by side to side engagement of the scrubber element cleansing medium and the surface being cleaned.

Figure 3:
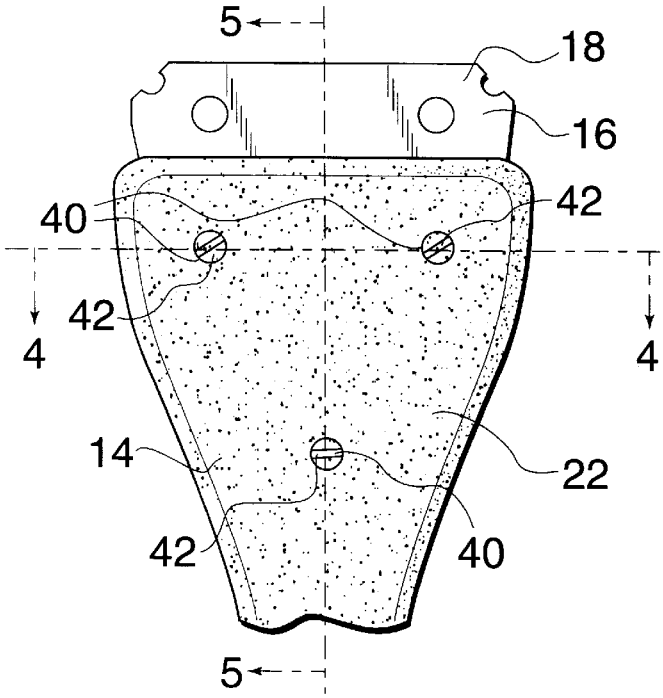
FIG. 3 is a fragmentary rear plan view of the ansate cleaning implement and showing a plurality of screws which secure the scrubber element within the socket.

With reference now to FIGS. 3, 4 and 5, it should be noted that the rear face 22 of the base 14 includes a plurality of enlarged apertures 40 and coaxial bores which carry threaded screws, 42. The screws 42 extend through their respective bores and engage concentric registered bores in the support plate 28 and concentric metal nuts 44 carried in the support plate 28. The support plate may be molded with the nuts positioned as cores.

It should be noted that self-tapping screws may be employed without metal nuts. Because the working load forces encountered by the bristles 30 are borne by the boundary wall and the borders 34, 36 and 38, the screws 42 merely serve to prevent the scrubber element from being removed from the socket 24 by axial displacement. Thus, the screws 42 do not bear any significant loads.

Alternate retention mechanisms may be readily employed, such as a latch, a snap detent and hook and loop type fastener strips adhered respectively to the axial end wall 33 of the socket and the outer face of the support plate 28. A magnetic catch may also be employed by adhering magnetic strip material to opposed surfaces of the socket and the support plate. Further, adequate retention of the scrubber element in the socket can be achieved by providing a peripheral lip on opposed end boundary walls defining the borders 34, 36 with the lip engaging an indentation or overlying the corresponding surfaces of the support plate 28 for snap fit engagement.

Figure 6:
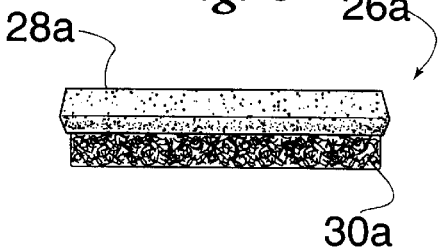
FIG. 6 is a side elevational view of an alternate scrubber element wherein a fibrous pad is employed as the cleansing medium.

In accordance with the invention, the scrubber element 26 is to be removed for cleaning in a dishwasher, replacement when worn, or substitution with a scrubbing element having a different cleansing medium to suit the task at hand. For example, illustrated in FIG. 6, is an alternate scrubber element **26*a* having a support plate 28*a* identical to the support plate previously described. In lieu of bristles, however, the scrubber element 26*a* includes a cleansing medium comprising a fibrous nonwoven pad 30*a*** such as pads sold under the trademark SCOTCH-BRITE. Similarly, the cleansing medium may comprise a fibrous metal pad formed of steel, copper or other metal, a pumice type material, etc.

What is claimed is:

1. An ansate cleaning implement, the cleaning implement comprising a base and a handle attached to the base, the base having a face intended to be oriented toward a surface in need of cleaning, a socket formed in the base, the socket being open at the face, the socket having a geometric plan configuration, a scrubber element, the scrubber element having a cleansing medium, the scrubber element having a geometric plan configuration mating with that of the socket, the scrubber element being dimensioned to be received in the socket with the cleansing medium being exposed and facing the surface in need of cleaning, a boundary wall completely surrounding the socket, the base having a minimum thickness within the socket, the base having a thickness greater than the minimum thickness at the boundary wall, the base including a leading edge and a pair of side edges, the base having a thickness greater than the minimum thickness between the boundary wall and the leading edge, between the boundary wall and the side edges and between the boundary wall and the handle, the cleaning implement further including a fastener releasably securing the scrubber element in the socket, the fastener preventing inadvertent axial dislodgement of the scrubber element from the socket, whereby the scrubber element may be removed for cleaning or for replacement when worn.

2. An ansate cleaning implement as constructed in accordance with claim 1, wherein the base and the handle are unitarily formed of a nonporous material in one piece construction.

3. An ansate cleaning implement as constructed in accordance with claim 1 wherein the socket is formed as a depression in the base.

4. An ansate cleaning implement as constructed in accordance with claim 1 further including a plurality of scrubber elements, each scrubber element having a different cleansing medium, whereby the scrubber element releasably secured in the socket may be removed for substitution with a scrubber element having a different cleansing medium and the cleaning implement is thus well suited for a wide variety of cleaning tasks.

5. An ansate cleaning implement as constructed in accordance with claim 1 wherein the socket includes an axial end wall, the boundary wall extending from the face of the base to the axial end wall of the socket.

6. An ansate cleaning implement as constructed in accordance with claim 1 wherein the scrubber element comprises a support plate, the support plate carrying the cleansing medium, the support plate having a geometric plan configuration mating with that of the socket.

7. An ansate cleaning implement as constructed in accordance with claim 1 wherein the base includes a rear face intended to be oriented away from the surface in need of cleaning, the face intended to be oriented toward the surface in need of cleaning and the rear face being equidistantly spaced from one another.

8. An ansate cleaning implement as constructed in accordance with claim 1 wherein the fastener comprises a screw extending from the base into the scrubber element.

9. An ansate cleaning implement as constructed in accordance with claim 1 wherein the boundary wall is in abutting engagement with and restrains the scrubber element from movement relative to the base in response to front to back and lateral forces encountered between the cleansing medium and the surface in need of cleaning.

10. An ansate cleaning implement, the cleaning implement comprising an elongate handle, a base carried at one end of the handle, the base and the handle being unitarily formed of one piece construction, a hollow socket formed in the base, a plurality of scrubber elements, each scrubber element having a different cleansing medium, a selected scrubber element releasably secured in the socket, the base having a boundary wall peripherally defining the socket, the base including borders extending from the boundary wall away from the socket, the borders captively restraining the scrubber element against front to back and lateral movement relative to the base, the cleaning implement further including a fastener releasably securing the scrubber element in the socket against axial dislodgement whereby the scrubber element releasably secured in the socket may be removed for substitution with a scrubber element having a different cleansing medium and the cleaning implement is thus well suited for a wide variety of cleaning tasks.

11. An ansate cleaning implement as constructed in accordance with claim 10 wherein the socket includes an axial end wall, the boundary wall extending from the face of the base to the axial end wall of the socket.

12. An ansate cleaning implement as constructed in accordance with claim 1 wherein the scrubber element comprises a support plate, the support plate carrying the cleansing medium.

13. An ansate cleaning implement, the cleaning implement comprising a base and a handle attached to the base, the base having a face intended to be oriented toward a surface in need of cleaning, a socket formed in the base, the socket being open at the face, the socket having a geometric plan configuration, a scrubber element, the scrubber element having a cleansing medium, the scrubber element having a geometric plan configuration mating with that of the socket, the scrubber element being dimensioned to be received in the socket with the cleansing medium being exposed and facing the surface in need of cleaning, a boundary wall completely surrounding the socket, the base having a minimum thickness within the socket, the base having a thickness greater than the minimum thickness at the boundary wall, the cleaning implement further including a screw releasably securing the scrubber element in the socket, the screw extending from the base into the socket, the screw preventing inadvertent axial dislodgement of the scrubber element from the socket, whereby the scrubber element may be removed for cleaning or for replacement when worn.

14. An ansate cleaning implement as constructed in accordance with claim 13 wherein the base and the handle are unitarily formed of a nonporous material in one piece construction.

15. An ansate cleaning implement as constructed in accordance with claim 13 wherein the socket is formed as a depression in the base.

16. An ansate cleaning implement as constructed in accordance with claim 13 further including a plurality of scrubber elements, each scrubber element having a different cleansing medium, whereby the scrubber element releasably secured in the socket may be removed for substitution with a scrubber element having a different cleansing medium and the cleaning implement is thus well suited for a wide variety of cleaning tasks.

17. An ansate cleaning implement as constructed in accordance with claim 13 wherein the socket includes an axial end wall, the boundary wall extending from the face of the base to the axial end wall of the socket.

18. An ansate cleaning implement as constructed in accordance with claim 13 wherein the scrubber element comprises a support plate, the support plate carrying the cleansing medium, the support plate having a geometric plan configuration mating with that of the socket.

19. An ansate cleaning implement as constructed in accordance with claim 13 wherein the base includes a rear face intended to be oriented away from the surface in need of cleaning, the face intended to be oriented toward the surface in need of cleaning and the rear face being equidistantly spaced from one another.

20. An ansate cleaning implement as constructed in accordance with claim 13 wherein the boundary wall is in abutting engagement with and restrains the scrubber element from movement relative to the base in response to front to back and lateral forces encountered between the cleansing medium and the surface in need of cleaning.

* * * * *